United States Patent [19]

Vasquez

[11] 3,980,995

[45] Sept. 14, 1976

[54] ALARM SYSTEM

[76] Inventor: Tulio Vasquez, Carrera 43A No. 30-91, Medellin, Colombia

[22] Filed: Dec. 17, 1974

[21] Appl. No.: 533,704

[52] U.S. Cl. ..... 340/213 R; 340/276; 307/99; 317/123

[51] Int. Cl.[2] ..... G08B 19/00

[58] Field of Search ..... 340/213 R, 409, 256, 340/276, 274, 285; 317/123 R, 135 R; 307/86, 97, 116

[56] References Cited

UNITED STATES PATENTS

| | | | |
|---|---|---|---|
| 3,215,996 | 11/1965 | Schwartz et al. | 340/256 X |
| 3,309,685 | 3/1967 | Manning | 340/256 X |
| 3,665,461 | 5/1972 | Gnagi | 340/409 |
| 3,778,797 | 12/1973 | Killen | 340/213 R X |
| 3,813,662 | 5/1974 | Lewis | 340/213 R |

*Primary Examiner*—John W. Caldwell
*Assistant Examiner*—William M. Wannisky
*Attorney, Agent, or Firm*—Browdy and Neimark

[57] ABSTRACT

It is herein disclosed a closed circuit alarm system comprising a number of alarm detectors, which system comprises an amplifier coupled through condensers to a first alarm relay and which is further coupled to a second relay the arrangement being such that when an electrical signal is generated in the first relay, in response to the bridging of any of the alarm detectors, such electrical signal is amplified and applied to such second relay thereby producing by said second relay an electrical signal which is applied to the first relay which then operates for putting the alarm device in the circuit. The circuit alarm detectors, series connected with the first alarm relay, are supplemented with electrical resistance elements in such a manner that when the electrical inlet of any of the alarm detectors is bridge-connected, an electrical resistance element associated therewith is also bridge-connected, thereby originating an electrical signal which will be amplified to operate the alarm device of the alarm circuit.

3 Claims, 1 Drawing Figure

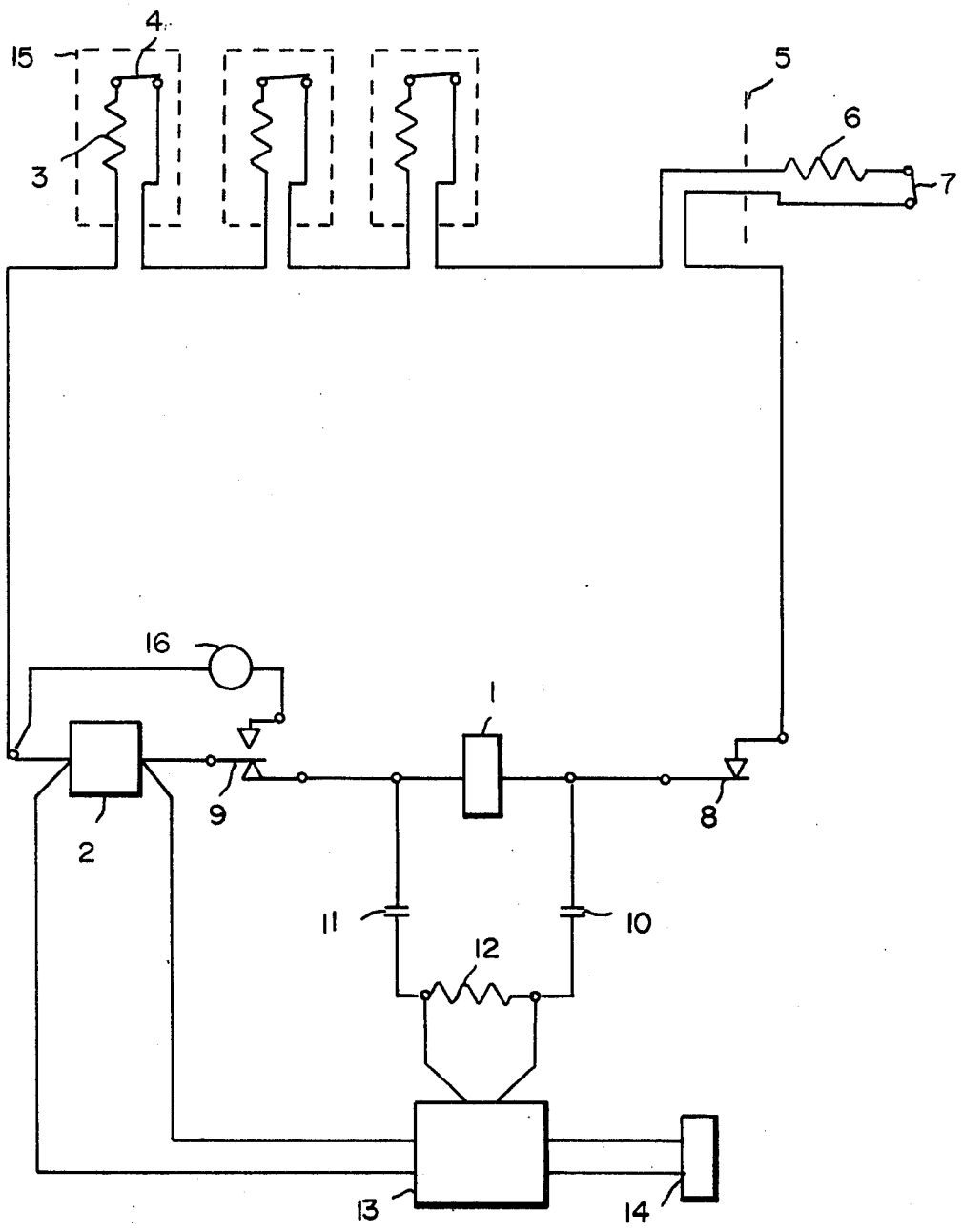
4
15
3
5
6
7
16
1
9
8
2
11
10
12
13
14

ALARM SYSTEM

BACKGROUND OF THE INVENTION

The present invention broadly relates to electric alarms of the closed circuit type. The alarm systems of the closed circuit type trigger the alarm signal when any of the circuit-breaker detectors is opened or when the circuit-breakers connecting line is cut. This occurs because of the alarm relay, which is maintained normally energized, is deenergized and as a result its contact points operate for putting the alarm device in the circuit.

With the conventional alarm systems of the above closed circuit type there is the possibility that if an electrical bridge is established in the inlet of one of the circuit-breaker detectors, such circuit-breaker so bridged can be opened and no alarm signal will be produced at all. This occurs since the current in the closed circuit will continue circulating through the established bridge. The premises sought to be protected by such alarm systems therefore are likely to be tampered with, without the alarm system operating to give an alarm.

A conventional alarm of the closed circuit type normally comprises a plurality of detector elements, some of which may be located externally, or at least part of the feeding line interconnecting the detector elements is accessible from the outside. In some other cases, the detector elements, even though internally located, may still be susceptible of being electrically bridged, for instance if there are small openings such as spaces between rods of grates, through which the hands of non-authorized persons can be introduced in order to perform the bridging operation.

The present invention contemplates an electronic circuit in combination with the addition to the break-circuit detector elements of a closed circuit alarm system of an element of electrical resistance, whereby an electrical signal is produced in response to the electrical bridging of any of the detector elements of such closed circuit alarm system. This electrical signal is useful to energize the alarm device to protect the premises wherein the alarm system is set up.

SUMMARY OF THE INVENTION

The operation of the alarm system according to the invention is based on the following electrical arrangement. A supply feed current keeps an alarm relay excited through the series system comprising interconnecting conductors and circuit-breaker detectors of the alarm system, which detectors are normally kept in closed condition. In the several detectors which are to be accessibly located, thus allowing the likelihood of being bridge-connected, or otherwise in cases in which the electrical conductors or sections thereof, interconnecting such detectors have to remain accessible despite the fact that the connected detectors are concealed, a low-valued resistance element is series connected with the respective detector as well as in the sections of the electrical conductor wherein the bridge connection is likely to be carried out. Such a resistance element acts as a bridge connection.

In this way, the alarm relay will remain energized by the supply current and will be series connected with the several low-valued resistance elements associated within the circuit. By way of example, an alarm relay is fed by a 6-volt electrical supply through 10 equal valued resistances, the added values of which match the ohmic value of the alarm relay. Under such circumstances when bridge connecting one of the resistances, the voltage at the alarm relay, which in accordance with Ohm's Law must be of 3 volts, it will be suddenly increased to 3.16. That is a 5% voltage increase. The alarm system according to the present invention comprises an electronic amplifier fed by the same electrical supply feeding the alarm system wiring. The inlet to the amplifier is applied through two capacitors from the terminals of the alarm relay in such a way that the 0.16 surge voltage brings about a signal of enough strength that the amplifier transiently energizes a second relay. The contact points of the second relay are normally closed and are series connected to the coil of the alarm relay. Therefore, when momentarily opening the series, the operation of the alarm relay is triggered. This alarm relay will be provided with clamping means, which need not be described herein since they do not form part of the present invention.

DESCRIPTION OF THE DRAWING

The accompanying drawing is a diagrammatic view illustrating the alarm system according to the present invention.

DESCRIPTION OF THE PREFERRED EMBODIMENT

The foregoing object of this invention will appear more clearly from the detailed description of the preferred embodiment thereof viewed in conjunction with the accompanying drawing. As previously indicated the invention relates to a closed circuit alarm system comprising in combination with resistances added to the detector elements an electronic amplifier which acts on a relay having its contact points normally closed and which relay originates the triggering of the alarm when a bridge connection is effected in one of the alarm detectors.

The circuit comprises an electrical source 2 connected to energize the coil of a relay 1 provided with self-clamping means, and which maintains its contact points 9 normally open; the points 9 are shown in the position of relay energized condition. The coil of relay 1 will be kept energized for so long as the interconnecting wiring and the several detectors remain closed. When the circuit is opened, the coil is activated, and the operating points 9 will be moved to energize the alarm device 16, by closing its electrical circuit by contact originated by the movement of points 9 to closed condition.

In the event that a bridge be connected in the inlet of the assembly 15, illustrated by the arrangement of elements 3 and 4, a sudden increase in the current circulating through the coil of the relay 1 will be originated, because the resistance of assembly 15 remains in a bridged connection. This sudden increase of current in turn brings about a sudden increase of voltage in the coil of relay 1. Since continuous current is being circulating and due to the connection shown of the capacitors 10 and 11 in the circuit of the coil of the relay 1, there will normally be no voltage difference between the ends of resistance 12. However, when the sudden voltage increase is originated in the coil of relay 1, while the capacitors are charged to the new voltage, they allow the current to circulate therethrough, which will produce a small voltage variation between the ends of resistance 12. This voltage being amplified by the amplifier 13 brings about a short period energization of the relay 14 which momentarily opens its points 8 normally closed. This in turn brings about deactivation of the relay 1 thereby causing the energization of the alarm device as explained hereinabove.

The circuit-breaker 7 shows the location of a detector placed in an outer area limited by, for instance, the fence 5 indicated in phantom. In the even that the interconnecting cable be bridge-connected, the resistance 6 will be bridge-connected and an alarm signal will be produced as explained above.

In the foregoing, it has been described a preferred embodiment of the invention. Nevertheless, it should be understood that some changes, substitutions or additions, obvious to those skilled in the art, can be made without departing from the scope of the invention. Thus, for instance, the number of detector elements may be varied. The relay 1 may be of the electromagnetic or electronic type. Likewise the relay 14 may be provided with additional contact points other than its normally closed contact points 8, in order to record the event that the relay was energized, thus allowing an operator to know if any bridge-connection in the system operation has occurred.

What is claimed is:

1. In a closed circuit alarm system including a power source, alarm generating means and a main alarm relay having a first relay coil, the improvement comprising:

a plurality of detector elements in a series connection with said main alarm relay;

a resistance element associated with each of said detector elements and in a series connection therewith;

sensing means connected in parallel with said first relay coil for sensing a change in the current flowing through said first relay coil and generating a signal in response to said change, said sensing means including first and second capacitors, said first capacitor being electrically connected to one side of said first relay coil and said second capacitor being electrically connected to the other side of said first relay coil;

a resistance element electrically connected to said first and second capacitors in series with said first relay coil;

amplifying means connected to said resistance element for amplifying the voltage across said resistance element and generating said signal, said signal corresponding to the voltage across said resistance element; and a second relay connected to said sensing means for deenergizing said main alarm relay in response to said signal;

whereby said alarm relay is activated when said detector elements are cut or shunted.

2. The closed circuit alarm system of claim 1, wherein said amplifying means comprises an electronic amplifier having an output terminal and said relay means includes a second relay coil connected to the output of said amplifier and said second relay coil has associated therewith a contact in series connection with said main alarm relay which contact is opened when said second relay coil is energized by said signal at the output terminal of said amplifier.

3. In a closed circuit alarm system including a power source, an alarm generating means connected to said power source, a main alarm relay coil connected to said alarm generating means, and sensing means, the improvement wherein said sensing means includes first and second capacitors, said first capacitor being electrically connected to one side of said main alarm relay coil and said second capacitor being electrically connected to the other side of said main alarm relay coil; a resistance element electrically connected to said first and second capacitors in series with said main alarm relay coil; and amplifying means connected to said resistance element for amplifying the voltage across said resistance element and generating a signal, said signal corresponding to the voltage across said resistance element.

* * * * *